US007048511B2

(12) United States Patent
Weng

(10) Patent No.: US 7,048,511 B2
(45) Date of Patent: May 23, 2006

(54) DEVICE FOR PREVENTION OF BACKWARD OPERATION OF SCROLL COMPRESSORS

(75) Inventor: Chuan Weng, Weaverville, NC (US)

(73) Assignee: Kendro Laboratory Products, Inc., Asheville, NC (US)

( * ) Notice: Subject to any disclaimer, the term of this patent is extended or adjusted under 35 U.S.C. 154(b) by 0 days.

(21) Appl. No.: 11/061,776

(22) Filed: Feb. 22, 2005

(65) Prior Publication Data

US 2005/0147499 A1 Jul. 7, 2005

Related U.S. Application Data

(62) Division of application No. 10/101,603, filed on Mar. 21, 2002, now Pat. No. 6,893,227.

(51) Int. Cl.
*F04B 49/00* (2006.01)

(52) U.S. Cl. ..... 417/32; 417/44.1; 62/228.1

(58) Field of Classification Search ..... 62/158, 62/228.1; 417/12, 32, 44.1, 44.3
See application file for complete search history.

(56) References Cited

U.S. PATENT DOCUMENTS

| | | | | |
|---|---|---|---|---|
| 3,339,829 A | | 9/1967 | Connor | 417/44.3 |
| 3,673,811 A | | 7/1972 | Adams et al. | 417/13 |
| 3,817,052 A | | 6/1974 | Connelly et al. | 62/158 |
| 4,537,038 A | | 8/1985 | Alsenz et al. | 417/12 |
| 4,602,484 A | | 7/1986 | Bendikson | 62/158 |
| 4,820,130 A | * | 4/1989 | Eber et al. | 417/32 |
| 4,955,795 A | | 9/1990 | Griffith | 417/44.3 |
| 5,200,872 A | | 4/1993 | D'Entremont et al. | 417/44.11 |
| 5,368,446 A | * | 11/1994 | Rode | 417/32 |
| 5,377,497 A | | 1/1995 | Powell | 417/12 |
| 5,452,989 A | * | 9/1995 | Rood et al. | 417/32 |
| 6,085,530 A | * | 7/2000 | Barito | 417/32 |
| 6,171,064 B1 | | 1/2001 | Hugenroth et al. | 417/32 |
| 6,185,949 B1 | | 2/2001 | Madigan | 62/222 |
| 6,210,119 B1 | | 4/2001 | Lifson et al. | 417/44.1 |
| 6,280,146 B1 | | 8/2001 | Bush et al. | 417/13 |
| 6,406,265 B1 | * | 6/2002 | Hahn et al. | 417/44.1 |
| 6,652,238 B1 | * | 11/2003 | Kajiwara et al. | 417/44.1 |

* cited by examiner

*Primary Examiner*—Michael Koczo, Jr.
(74) *Attorney, Agent, or Firm*—Baker & Hostetler LLP

(57) ABSTRACT

A method and apparatus which provides a pressure sensor and/or temperature sensor connected to the low pressure side of a refrigeration system, or the discharge line of a scroll compressor. When the scroll compressor rotates backward, the change of pressure or temperature immediately sends a signal to work with a time-delay relay and a normally closed relay to immediately cut off the electrical power supply to the compressor. Thus, causing the scroll compressor to stop rotating in the undesirable direction.

6 Claims, 2 Drawing Sheets

DEVICE FOR PREVENTION OF BACKWARD OPERATION OF SCROLL COMPRESSORS

CROSS-REFERENCE TO RELATED APPLICATIONS

This application claims priority to and is a divisional of U.S. patent application entitled, DEVICE FOR PREVENTION OF BACKWARD OPERATION OF SCROLL COMPRESSORS, filed Mar. 21, 2002, having a Ser. No. 10/101,603, now U.S. Pat. No. 6,893,227, the disclosure of which is hereby incorporated by reference in its entirety.

FIELD OF THE INVENTION

The present invention relates generally to scroll compressors. More particularly, the present invention relates to a device for preventing backward operation of scroll compressors.

BACKGROUND OF THE INVENTION

Scroll compressors have become very popular in many applications. They can be found in low temperature refrigeration systems, air-conditioning systems and specialty refrigeration systems. Scroll compressors are becoming more and more popular for use as compressors in both refrigeration as well as air conditioning and heat pump applications due primarily to their capability for extremely efficient operation. Despite the variations in application or use, the fundamental function of the compressor is unchanged. It compresses refrigerant vapor for condensing. Heat can then be removed from the condensed vapor and the vapor then used as a cooling source.

A typical scroll compressor is comprised of three basic components. There are two mating scroll elements and an electric single-phase or three-phase motor that drives the orbiting motion of one of the scroll elements for compression of gases. Generally, these machines incorporate a pair of intermeshed spiral wraps, one of which is caused to orbit relative to the other so as to define one or more moving chambers which progressively decrease in size as they travel from an outer suction port toward a center discharge port. An electric motor is provided which operates to drive the orbiting scroll member via a suitable drive shaft.

Because scroll compressors depend upon a seal created between opposed flank surfaces of the wraps to define successive chambers for compression, suction and discharge valves are generally not required. However, when such compressors are shut down, either intentionally as a result of the demand being satisfied, or unintentionally as a result of power interruption, there is a potential for the pressurized chambers and/or backflow of compressed gas from the discharge chamber to effect a reverse orbital movement of the orbiting scroll member and associated drive shaft.

When there is a brief interruption of electric power on a single-phase model, the electric motor stops. When this happens, pockets of high pressure gas can get trapped between the scroll elements and can drive the scroll parts to rotate in the opposite or backward direction for a fraction of a second as the high pressure is relieved from the high pressure side to the low pressure side of the refrigeration circuit. If the electric power is resumed during this process, the compressor's motor will aid the backward rotation and result in a continuous backward operation. Because the compression of gases only occurs in the proper rotation, the backward motion effectively shuts down the movement of gases in the system. The associated equipment therefore malfunctions.

Since the brief power interruption could be as short as approximately twenty milliseconds, the detection of such a power change for prevention of backward operation is not always successful. This reverse movement often generates objectionable noise or rumble and possible damage.

Further, in machines employing a single phase drive motor, it is possible for the compressor to begin running in the reverse direction should a momentary power failure be experienced. This reverse operation may result in overheating of the compressor and/or other damage to the apparatus. Additionally, in some situations, such as a blocked condenser fan, it is possible for the discharge pressure to increase sufficiently to stall the drive motor and effect a reverse rotation thereof. As the orbiting scroll orbits in the reverse direction, the discharge pressure will decrease to a point where the motor again is able to overcome this pressure head and orbit the scroll member in the "forward" direction. However, the discharge pressure will now increase to a point where the cycle is repeated. Such cycling may also result in damage to the compressor and/or associated apparatus.

A need therefore exists for a mechanism for disabling operation of a scroll compressor during back pressure conditions to prevent backward operation of the compressor.

SUMMARY OF THE INVENTION

The foregoing need has been met by the present invention which provides a pressure sensor connected to the low pressure side of the refrigeration system, or a temperature sensor connected to the discharge line of the compressor. When the scroll compressor rotates backward, the change of pressure or temperature immediately sends a signal to work with a time-delay relay and a normally closed relay to immediately cut off the electrical power supply to the compressor. Thus, causing the compressor to stop rotating in the undesirable direction. The time-delay relay then resets itself after a predetermined time to allow the compressor to resume its normal operation automatically.

In one aspect of the invention, a system for prevention of backward operation of a scroll compressor is provided that includes a sensor that generates an electrical output signal. A control circuit is electrically connected to the sensor and the scroll compressor. The control circuit prevents any backward operation of the scroll compressor by turning the compressor on and off in response to the electrical output signal.

In another aspect of the invention, a method of preventing backward operation of a scroll compressor is provided wherein a condition in a system including the scroll compressor is sensed and an electrical signal representative of said condition is generated. The compressor is then turned off when the condition rises to a preset upper level and turned on when the condition lowers to a preset lower level.

In yet another aspect of the invention, a system for preventing backward operation of a scroll compressor and for generating an electrical signal representative of said condition. Means are also provided for turning the compressor off when the condition exceeds a preset upper level and turning said compressor on once a preset lower level is reached for the condition.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
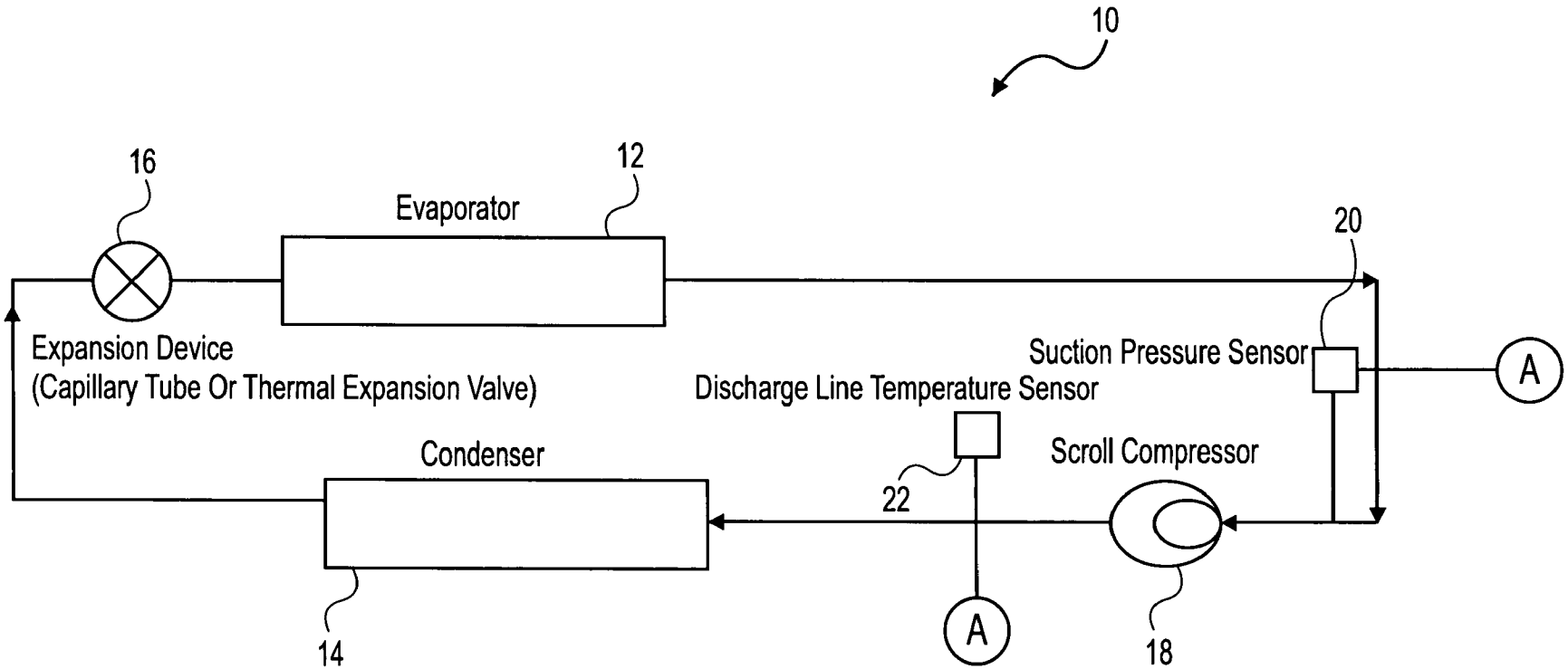
FIG. 1 is a refrigeration flow diagram of a preferred embodiment of the present invention.

A preferred embodiment of the present inventive apparatus and method is illustrated in FIG. 1. The present invention can be utilized, by way of example, in a refrigeration system 10 comprising an evaporator 12, a condenser 14, an expansion device 16, and a scroll compressor 18. As can be seen in FIG. 1, the refrigeration system 10 is a circuit in which refrigerant is compressed in the scroll compressor 18 and provided to the condenser 14. Heat is removed from the compressed gas in the condenser 14 before being provided to the expansion device 16. In a preferred embodiment of the invention, the expansion device 30 can be a capillary tube or thermal expansion valve.

As the compressed refrigerant passes through the expansion device 16, there is a pressure drop and a resultant drop in the temperature of the refrigerant as it passes into the evaporator 12. The evaporator 12 allows heat to be absorbed from the area to be cooled into the refrigerant. The refrigerant, which has now absorbed heat, is compressed again by the scroll compressor 18 and the cycle is repeated.

In the system of the present invention, the refrigeration system 10 has a pressure sensor 20 connected to the low pressure side of the refrigeration system 10, or a temperature sensor 22 connected to the discharge line of the compressor. These sensors respond to a change of pressure or temperature and immediately send an electrical signal (A) to a time-delay relay 24, FIG. 2, which turns off the scroll compressor 18. Thus preventing the scroll compressor 18 from rotating in an undesirable direction.

Figure 2:
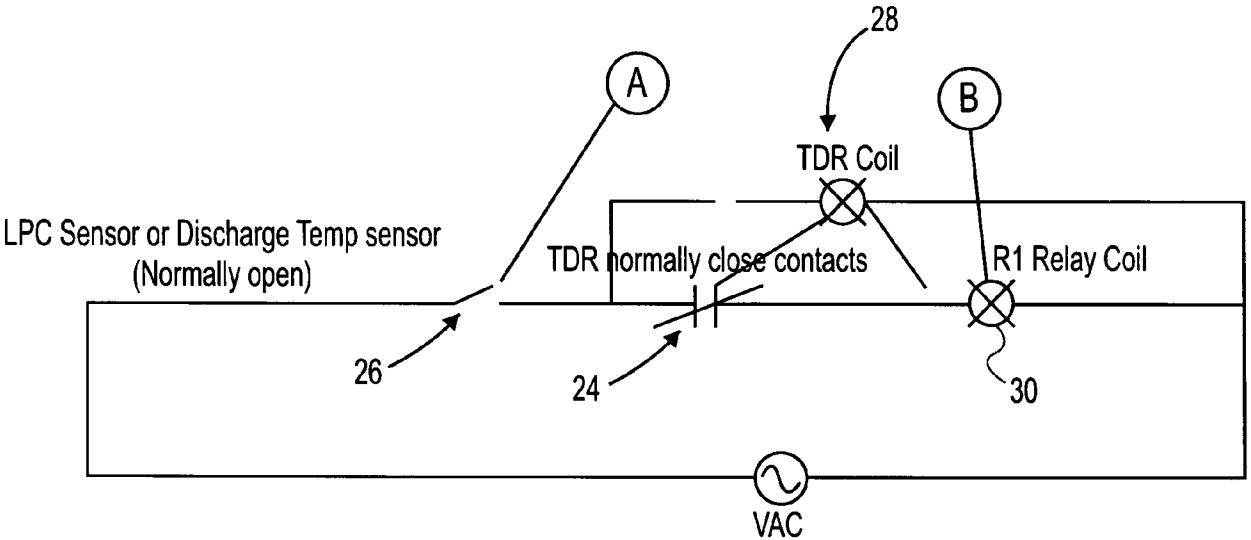
FIG. 2 is a control circuit diagram of a preferred embodiment of the present invention.

Now referring to FIG. 2, a low pressure control switch (LPC) 26 is normally left in the open position and is electrically connected (A) to the pressure sensor 20 or temperature sensor 22. In the case of a pressure sensor 20, the LPC 26 electrical contacts are closed when the suction pressure rises to a preset level higher than the normal operating pressure. The LPC 26 electrical contacts are open when the suction pressure drops to a lower preset level, e.g., the LPC 26 closes at 65 psig, and opens at 55 psig. It should be noted that normal compressor suction pressure is 35 psig.

This function can also be accomplished by a discharge temperature sensor 22, FIG. 1, attached to the discharge line of the compressor. The time delay relay (TDR) 24 has a pair of built-in electrical contacts that are normally closed. When the TDR coil 28 is energized, it delays the electrical contact motion by a preset time, e.g., twenty seconds.

Figure 3:
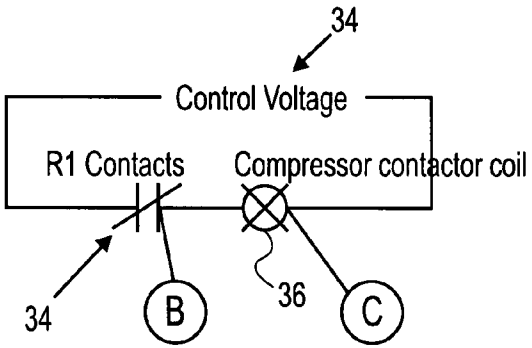
FIG. 3 is an electrical diagram of a preferred embodiment of the present invention.

In a normal on-cycle operation, a typical operating suction pressure is 35 psig. This is lower than the 55 psig cut-out setting of the LPC 26. Next, the LPC 26 electrical contacts open and the R1 coil 30 de-energizes. As shown in FIG. 3, R1's electrical contacts 34 are closed in order to energize the coil 36 of the compressor contactor. The compressor is powered up to operate.

Figure 4:
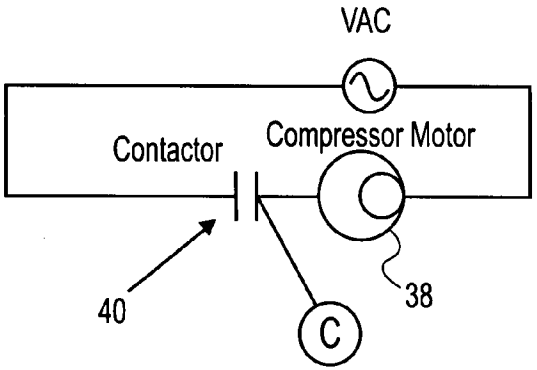
FIG. 4 is an electrical diagram of a preferred embodiment of the present invention.

In a normal off-cycle, a setpoint temperature is met, the control voltage 38 that is fed to the compressor contactor coil 36 reduces to zero at point (C), and the scroll compressor motor 38, FIG. 4, stops by means of the contactor 40. At the same time, the suction pressure rises to 65 psig in approximately three seconds. LPC 26 electrical contacts are closed. This energizes the TDR coil 28 and R1 coil 30; the normally closed electrical contacts of the R1 relay 34 are now open. As TDR 24 times-out in twenty seconds, it opens up the normally closed electrical contacts of the TDR 24 to de-energize the R1 coil 30. The electrical contacts of the R1 relay 34 return to their closed position. Now the system "waits" for the control voltage 38 to call for compressor motor 38 operation to resume. When the compressor motor 38 is turned on, the LPC 26 resets as the suction pressure falls. The compressor 18 now begins to run as usual.

In reverse motion mode, when a scroll compressor 18 turns backwards for any reason, the compression process stops. The suction pressure goes up immediately and the discharge temperature falls. When the suction pressure rises from a normal operating 35 psig to 65 psig in about three seconds, the LPC 26 electrical contacts are closed. (A normally open temperature sensor 22 attached to the compressor discharge line can also achieve this result since the discharge temperature drops when the compressor stops or rotates backwards). This reverse motion starts the time-out mode of the TDR 24 and then the R1 coil 30 immediately is powered up to open its normally closed electrical contacts. This motion terminates the power supply at point (C) to the main compressor contactor coil 36. Thus, scroll compressor motor 38 stops its motion. After the TDR 24 expires in twenty seconds, the R1 relay 34 is released to close the contactor coil 36. The compressor motor 38 is powered again to return to the normal operation mode. The TDR coil 28 remains energized until the suction pressure is pulled below the cut-out point of the LPC 26 at 55 psig. TDR 24 is then completely out of the electrical circuit and ready for the normal operation and the prevention of the next occurrence of continuous backward rotation.

During initial start-up, when the soak pressure is higher than 65 psig, the TDR 24 times-out in twenty seconds as soon as electrical power is on. Now the equipment is ready for operation.

Since the present invention does not depend on how the reverse rotation occurs, and only works with a consistent change of pressure and temperature signals, it is therefore a highly reliable method of preventing the scroll compressor from rotating in the undesirable direction for any extensive length of time which can cause damage.

The present invention is not limited to laboratory applications. It can also be used in any other applications where scroll compressors are the main force, such as air-conditioning, industrial testing chambers, and industrial refrigeration systems.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system for prevention of backward operation of a scroll compressor, comprising:

a temperature sensor that generates an electrical output signal; and a control circuit electrically connected to said sensor and said scroll compressor, wherein said control circuit prevents backward operation of said scroll compressor by turning a compressor motor on and off in response to said electrical output signal.

2. The system of claim 1, wherein said temperature sensor is connected to the discharge line of the scroll compressor.

3. The system of claim 1, wherein said control circuit farther comprises a discharge temperature switch electrically connected to said sensor.

4. The system of claim 3, wherein said discharge temperature switch closes if the temperature rises above a preset maximum temperature level.

5. The system of claim 4, wherein said discharge temperature switch opens if the temperature falls below a preset minimum level.

6. A system for prevention of backward operation of a scroll compressors, comprising:

means for sensing a condition in a system including said scroll compressor and for generating an electrical signal representative of said condition; and means for turning said compressor motor off once a preset upper level is reached for said condition and turning said compressor on once a preset lower level is reached for said condition, wherein the means for sensing is a temperature sensor connected to the discharge line of the scroll compressor.

* * * * *

UNITED STATES PATENT AND TRADEMARK OFFICE

CERTIFICATE OF CORRECTION

PATENT NO. : 7,048,511 B2
APPLICATION NO. : 11/061776
DATED : May 23, 2006
INVENTOR(S) : Chuan Weng It is certified that error appears in the above-identified patent and that said Letters Patent is hereby corrected as shown below:

Column 6,
Line 4, please replace "farther" with -- further --.

Signed and Sealed this

Fifth Day of September, 2006

JON W. DUDAS
*Director of the United States Patent and Trademark Office*